United States Patent [19]

Thomas et al.

[11] 4,031,690

[45] June 28, 1977

[54] NOISE SUPPRESSION APPARATUS AND METHOD FOR FALSE-TWIST TEXTURING MACHINES

[75] Inventors: Lorimer Phillip Thomas; Robert Harold Walker, both of Greensboro, N.C.

[73] Assignee: Burlington Industries, Inc., Greensboro, N.C.

[22] Filed: Oct. 2, 1975

[21] Appl. No.: 618,969

[52] U.S. Cl. ..... 57/1 R; 57/34 HS; 181/33 K; 181/61

[51] Int. Cl.[2] ..... D02G 1/02; G10K 11/00

[58] Field of Search ..... 57/1 R, 34 HS, 34 R, 57/136, 137; 181/33 R, 33 C, 33 G, 33 GD, 33 K, 61, 62, 64 A

[56] References Cited

UNITED STATES PATENTS

| | | | |
|---|---|---|---|
| 2,694,896 | 11/1954 | Winslow et al. | 57/1 R |
| 2,758,439 | 8/1956 | Bradshaw | 57/136 |
| 2,968,909 | 1/1961 | Comer et al. | 57/34 HS X |
| 2,976,667 | 3/1961 | Racicot | 57/34 HS |
| 3,393,765 | 7/1968 | Vitrinsky et al. | 181/33 R |
| 3,604,191 | 9/1971 | Jaeggli | 57/1 R |
| 3,713,509 | 1/1973 | Carroll | 181/33 K |
| 3,782,087 | 1/1974 | Franzen et al. | 57/1 R |
| 3,936,995 | 2/1976 | Laflaquiere et al. | 57/1 R |

*Primary Examiner*—John Petrakes
*Attorney, Agent, or Firm*—Cushman, Darby & Cushman

[57] ABSTRACT

The disclosure embraces noise abatement apparatus and a method of abating noise in a yarn texturing machine of the type that employs rotatable spindles driven by endless belts, heater means and yarn transport means, all of which are spaced along a frame between a gear housing and a motor housing; the apparatus includes sound insulating walls for enclosing the timing belt driven pulley located nearest the gear housing together with tunnels lined with sound absorbing material through which the endless belts of the machine pass from the gear housing over the frame of the machine; also, there are included means for isolating the vibrations of idler pulleys for the drive belts from the mounting rail as well as reducing sound propagation from the rotating idler pulleys; noise generated from within the gear housing of the machines is also suppressed.

11 Claims, 10 Drawing Figures

NOISE SUPPRESSION APPARATUS AND METHOD FOR FALSE-TWIST TEXTURING MACHINES

BACKGROUND AND BRIEF DESCRIPTION OF THE INVENTION

The present invention relates to noise abatement apparatus and a method of reducing noise levels and, more particularly, to a noise abatement apparatus and method for yarn treating machines which texture yarn at high production speeds.

It is well known that in many industrial operations workers are exposed to dangerously high noise levels which, over a period of time, can result in hearing impairment. It has also been known that worker productivity is adversely affected where the working conditions involve exposure to high levels of noise. As a result, various industrial and governmental bodies have proposed and enacted regulations and guidelines which require businesses to modify the production environments of their employees by reducing the sound levels to which the employees are exposed.

As a result of these regulations, resort has been had to the use of individually worn ear protectors or the use of sound baffles around various types of machinery.

The former solution has been found impractical due to the resistance of workers to consistently employing the ear protectors, and, since it is impractical to monitor machine operators to ascertain whether or not they are properly wearing ear protectors, of necessity, noise abatement techniques have been directed to installing various types of sound baffles around noise generating sources.

In a number of arrangements, it has been proposed to surround either the entire machine with a sound baffle or enclosure, or to mount sound absorbing panels on the machine to enclose the device which is the greatest sound generating source.

The technique of completely enclosing a piece of machinery, however, is practical only where the machinery is relatively cool running, i.e., non-heat generating, which is such a rare occurrence as to render this procedure of extremely limited utility.

The other proposed techniques of enclosing all or at least most of the principal noise generating sources of a machine have suffered from the disadvantages that such procedures encumber the use and operation of the machines by restricting access to the portions of the machines that require operator attention as well as contribute to heat build-up in the enclosed parts, thus requiring compensating and expensive cooling devices. Such cooling devices appreciably increase the cost of installing the sound insulating equipment which itself is an expensive undertaking, but which, nevertheless, is rendered necessary in the interest of preventing hearing impairment as well as augmenting productivity.

The following references are representative of the prior art:

| | |
|---|---|
| 3,393,765 | 3,747,735 |
| 3,604,531 | 3,782,087 |
| 3,633,706 | 3,860,086 |
| 3,695,386 | 3,866,708 |
| **3,700,068** | **3,867,875** |
| 3,713,509 | |

The present invention provides solutions to the foregoing problems without encountering the drawbacks of the prior art arrangements by concentrating its improvements on a specific type of noise generating machinery, i.e., a false twist texturing machine, whereby a satisfactory noise reduction is achieved by substantially fewer modifications to the machine than would be the case where the prior are techniques are employed.

Specifically, the present invention is directed to noise abatement in connection with a false twist texturing machine of the type that is provided with a number of yarn texturing positions each of which is provided with yarn feeding means for drawing yarn from a take-up package through a heater and false twist spindle and then delivering the yarn to a yarn take-up package.

Noise abatement techniques as applied to false twist machines, it has beem found, must take into consideration certain operational aspects of these machines, such as the fact that large quantities of heat are continuously generated by the heaters of the machines which must be dissipated so that the working environment may be maintained at a tolerable level. Additionally, access to the supply packages, heater, spindle and take-up packages must be continually provided for observation by an operator, so that any yarn breakages which frequently occur in these machines can be promptly rectified so as to minimize production losses and to avoid expensive fouling of the machine. As will be appreciated by those skilled in the art of texturing, presently operated false twist machines run at enormously high speeds corresponding to a yarn velocity through the machine on the order of 400 yards per minute, on the average. As a result, the noise generated by the moving parts of these machines are presently manufactured, can result in hearing impairment for an individual who is exposed to machines on a day-to-day basis.

According to the present invention, it has been found that substantially few modifications to a false twist texturing machine need be effected in order to bring the noise level of the machine operating at capacity within tolerable limits. Also, the cost of the modifications that are effected is substantially lower than that which would be the case if the total enclosure procedures were followed so that the present invention provides the economic incentive necessary to encourage manufacturers to adopt the sound suppressing method as described herein.

Specifically, it has been found that a significant noise level reduction can be achieved in yarn texturing machines where a number of relatively simple modifications to the machine are made. Specifically, according to the present invention, noise generated by tape pulleys is eliminated by appropriate modification of the pulleys and by enclosing in a suitably muffled enclosure the head end tape pulley. Additionally, tunnels are provided for the drive belt of the tape pulleys at a specific location with the tunnels being lined with sound absorption material so that noise generated within the gear housing will be attenuated in the tunnels. Also, the idler pulleys which are driven by the drive belt are provided with vibration isolation mountings and sleeves, the latter serving both to increase the diameter of the pulleys and thus reduce their rotational speed and to provide a dissimilar outer metal casing which will serve as a sound impedance barrier and frictional damper.

Also, according to the invention, all unnecessary openings in the gear housing are closed with panels which are mounted on the interior or exterior of the housing. Also, the inside surfaces of the gear housing should be lined with a sound absorption material.

Preferably, the conventional plastic sheet protectors that are provided with a conventional false twist machine as a protection for an operator and which are located adjacent the spindles can also be lined with a suitable sound adsorption material and these deflectors should be repositioned as closely as possible to the spindle heads.

Additional noise suppressing procedures, which are described in detail in the following description, will contribute to the overall noise reduction when combined with the foregoing procedures and devices, whereby the possibility of hearing impairment will be substantially reduced since the noise levels will be suppressed at the source as opposed to during their transmission or at the receiver. Thus, the necessity of enclosing the production portions of the machine, together with the attendant problems as a result of heat build-up are avoided, while the machine attendants will no longer be encumbered by earplugs or ear muffs, which can be a source of danger particularly in the event of an emergency in a plant.

The foregoing and other advantages will become apparent as consideration is given to the following detailed description and accompanying drawings in which:

DETAILED DESCRIPTION OF THE INVENTION

Figure 1:
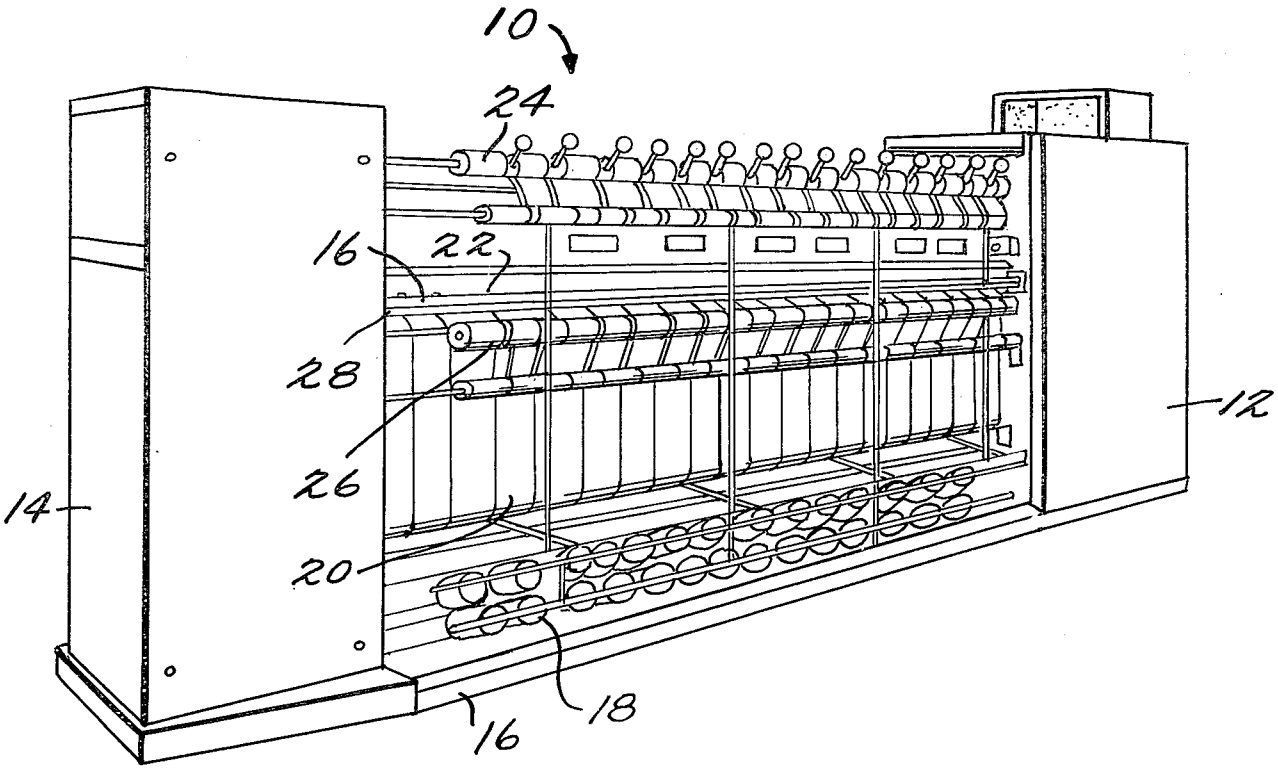
FIG. 1 is a perspective view of a single heater false twist texturing machine.

Referring to FIG. 1, there is illustrated a perspective view of a false twist texturing machine 10, the operation of which is conventional and widely understood in the textile industry. In brief, a texturing machine such as the Leesona 553 machine consists of a gear housing 12 at one end of the machine and a motor housing 14 at the other end of the machine. A frame such as at 16 extends between the housings 12 and 14 and supports a number of yarn texturing positions. Each yarn texturing position conventionally includes one or more supports for yarn supply packages such as at 18, a contact heater 20, a false twist spindle 22 and yarn take-up packages such as at 24 and 26. Suitable yarn drawoff and tensioning mechanisms (not shown) are also incorporated on these machines to pull yarn off the supply packages 18 over and in contact with the heater 20, through the false twist spindle and then to the take-up package 24.

With the false twist spindles 22 operating at extremely high speeds, for example, on the order of 300,000 to 500,000 rpm, the velocity with which yarn travels through the machine from the supply package 18 to the yarn take-up 24, must be correspondingly high, such as on the order of 400 to 500 yards per minute.

As in many conventional texturing machines, a single electric motor is employed is as the source of power so that relatively complex gearing installations must be employed to distribute the power at the appropriate speeds to the various mechanisms of the machine. In the Leesona 553 machine, as noted above, the motor is located in housing 14 whereas the principal gearing mechanisms are located in housing 12. From the motor in housing 14, rotary power is transmitted to the gear housing 12 by any suitable means such as a drive shaft or belt connection to the gears. From the gear housing 12, a number of drive shafts extend for operating the yarn feeding devices (not shown) which draw the yarn from the supply packages 18, as well as rotary shafts for operating the lower and upper feed rolls (not shown) and the usual traverse units and take-up devices 24. Also, from the gear housing 12, a spindle drive belt extends along the frame 16 for driving the spindle mechanisms disposed on the spindle rail 28, which is illustrated in more detail in FIG. 2.

Figure 2:
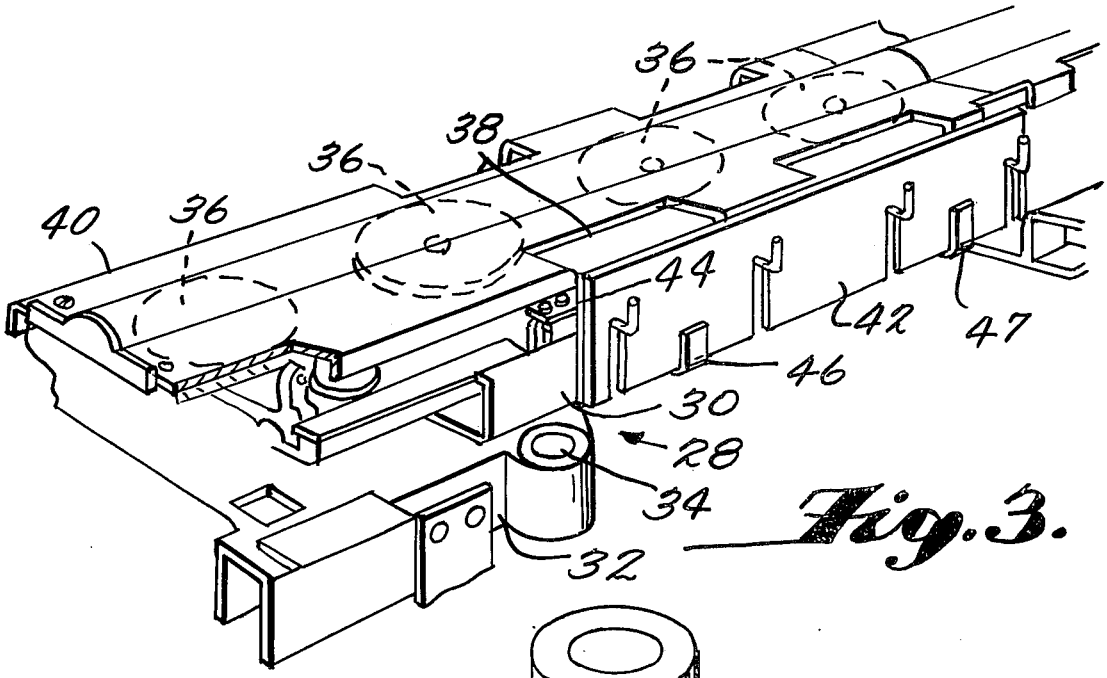
FIG. 2 is a perspective view with parts broken away of the spindle drive mechanism of the machine of FIG. 1.

There is illustrated in FIG. 2 a segment of the spindle rail 28 which comprises, in general, an elongated platform 30, which extends from one end of the machine to the other, and is supported at each end and at intermediate intervals by bridges 32, which are secured to supports by rods fixed in bores, one of which is illustrated at 34.

Spaced along the platform 30 of spindle rail 28 are a plurality of tape pulleys indicated in dotted lines at 36, and rotatably mounted on the platform 30. As will be described in detail hereinafter, the tape pulleys 36 are driven by a drive belt and in turn the pulleys rotate a spindle tape which is, in turn, in driving engagement with the false twist spindles which are positioned in the apertures 38 of a cover 40, which extends the length of the frame 16.

Mounted on the side of the platform 30 is a plexiglas deflector 42, which preferably is positioned at the level of the false twist spindles to protect persons working about the machine from injury due to parts flying out of the spindle in the event a spindle is damaged during use. According to the present invention the inner side of the deflector 42 is lined with a sound absorbing material as at 44, which may be a polyurethane foam pad provided with a self-adhesive coating on one side. Preferably, the deflector 42 is supported by a plurality of hooked brackets as at 46, which are secured to the side edge of the platform 30.

Figure 4:
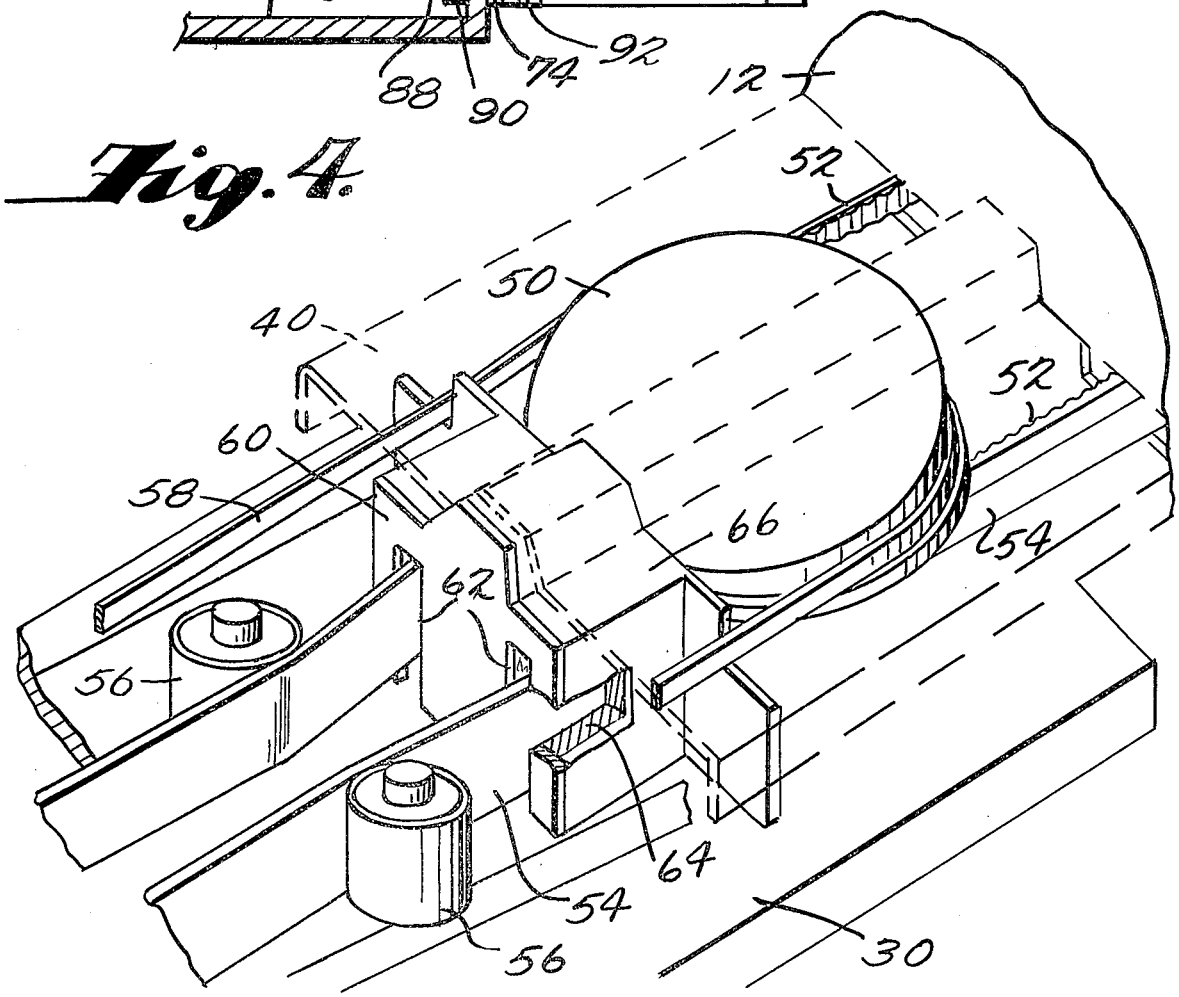
FIG. 4 is a perspective view with parts broken away of the head end tape pulley.

Adjacent the gear housing 12, there is located a head end tape pulley 50 which is illustrated in FIG. 4. The pulley 50 is mounted on a slidable plate (not shown) since this pulley is connected to the power source through a timing belt 52, which engages a drive on the under side of the pulley 50. The timing belt, in turn, is driven by a pulley located in the housing 12 which also is in driving engagement with an endless drive belt 54, which extends along the length of the frame 16 and is in driving engagement with whorls 99 (FIG. 6) of each of the tape pulleys 36. The tension on the drive belt 54 is regulated in part by the positioning against the belt 54 of a number of idler pulleys 56, the construction and mounting of which will be described hereinafter in more detail.

It has been found that a large portion of the noise level of the texturing machine has its source in the gear housing 12 with respect to the drive mechanisms for the spindle tape 58, which is driven by the tape pulleys 50 and 36. Specifically, it has been found that the timing belt 52, while operating, contributes significantly to the noise level. According to the present invention, then, an enclosure for the end pulley 50 is provided which consists of a sound insulated enclosure 60, which is located between the cover 40 and the platform 30 of the spindle rail. The exterior dimensions of the enclosure 60 are, of course, shaped to close the space between the cover 40 and the platform 30. In addition, the width or thickness of the enclosure 60 should be selected to sufficiently attenuate the noises associated with the operation of the pulley 50 and timing belt 52. To this end, enclosure 60 is provided with tunnels as at 62, which are lined with sound absorption material 64, which may be a polyurethane foam, or other suitable sound absorbing material. The upper surface 66 of the enclosure 60 should be shaped to closely interfit with the undersurface of the cover 40, as illustrated.

Figure 7A:
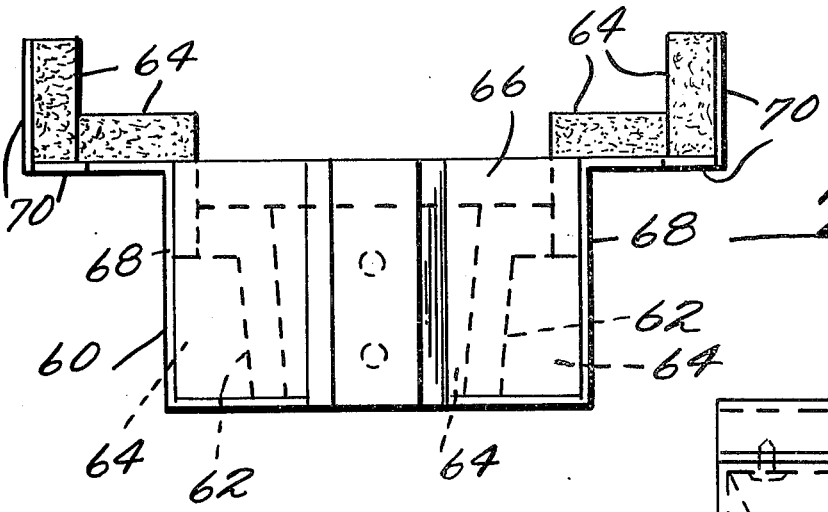
FIGS. 7A, 7B and 7C are top plan, side and front elevational views, respectively, illustrating the enclosure for the head end tape pulley.
Figure 7B:
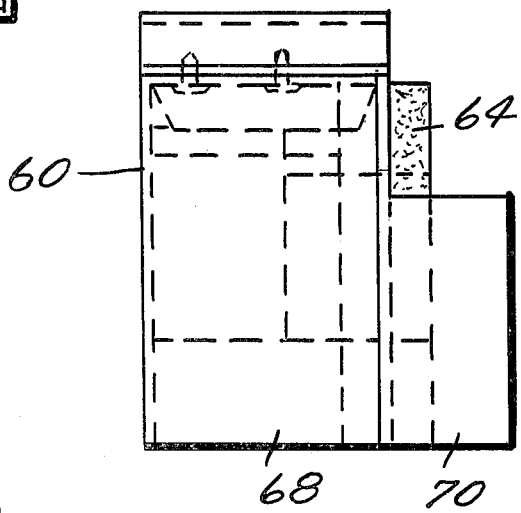
Figure 7C:
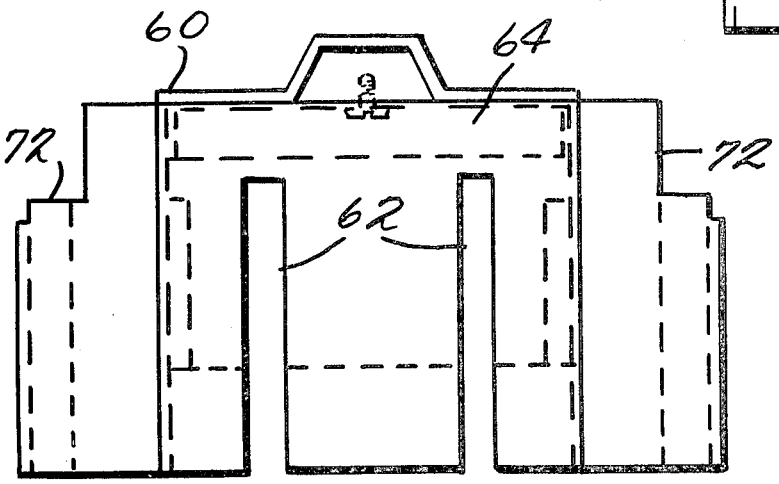

More detailed illustrations of the enclosure 60 are shown in FIGS. 7A, 7B, and 7C. In FIG. 7A a top view of the enclosure 60 is depicted showing the orientation of the tunnels 62 and the relative dispositions of the sound insulation 64, on the interior of the enclosure 60.

The wall portions of enclosure 60 may be made from a single piece of sheet metal that is bent into the illustrated configuration to form the top wall 66 and the side walls 68. The wall portions 70 which extend from the rear edges of the side walls 68 are provided with cut-out sections 72 through which the spindle tape 58 passes.

Preferably, the polyurethane foam sections 64 are provided with self-adhesive coatings to facilitate their adherance to the interior walls of the enclosure 60.

Figure 3:
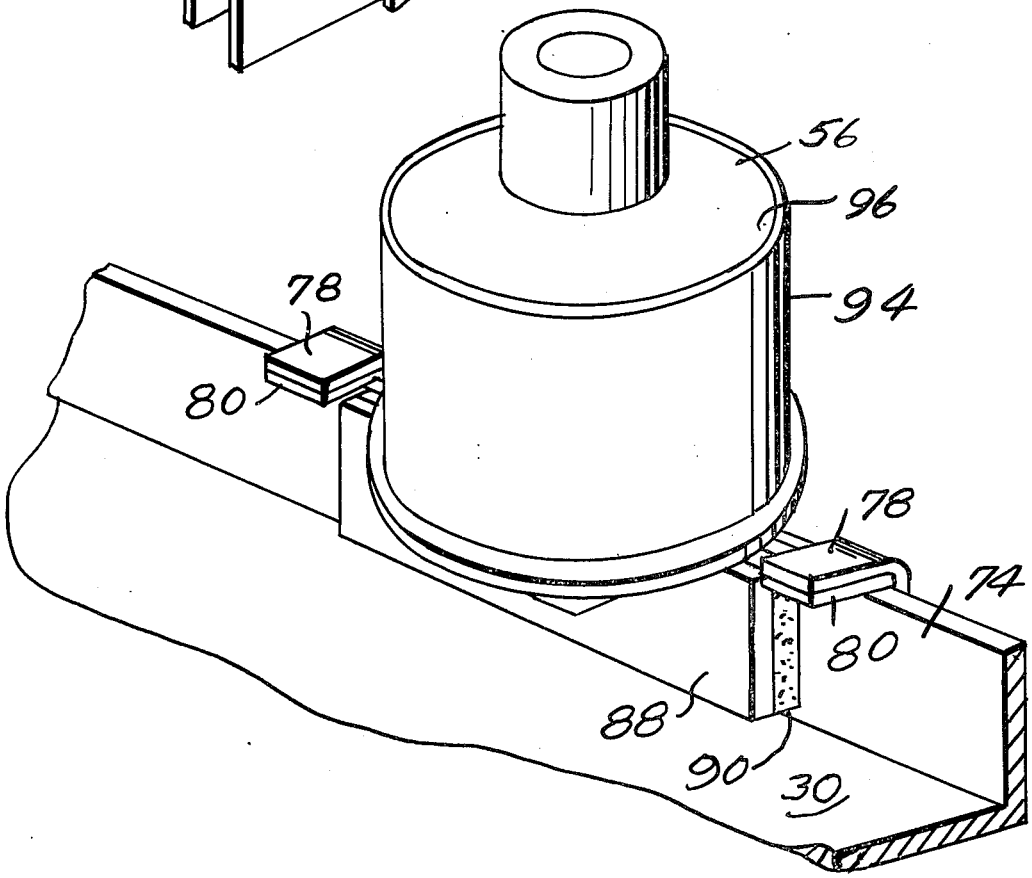
FIG. 3 is an enlarged view of an idler pulley carried on the spindle drive mechanism.
Figure 5:
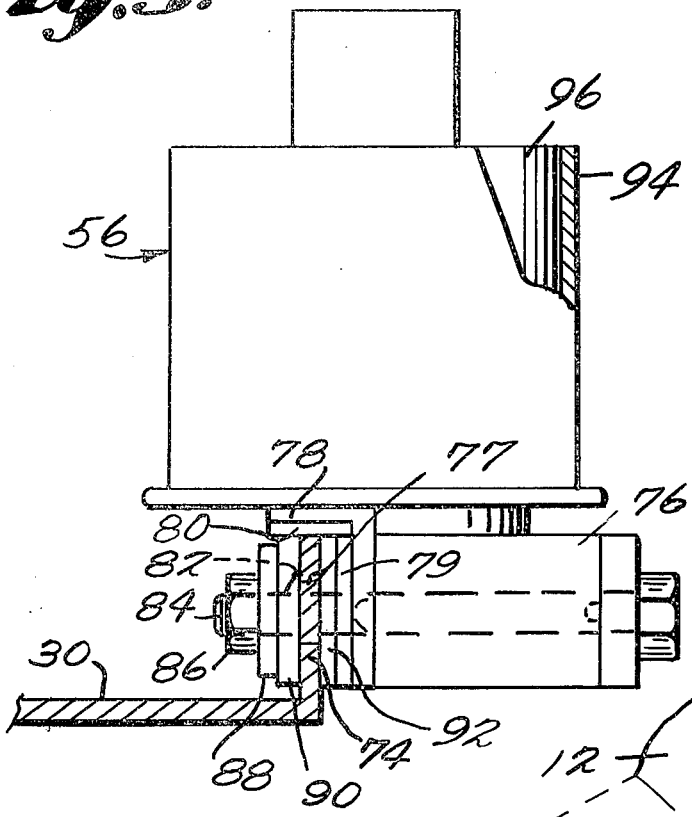
FIG. 5 is a view in elevation with parts broken away of the pulley of FIG. 3.

Other troublesome sources of noise in the spindle drive mechanism of the texturing machine are the idler pulleys 56 which are disposed in pairs along the platform 30. As illustrated in FIGS. 3, 4 and 5, each pulley 56 is mounted on a flange rail 74, which extends upwardly from the platform 30, on either side of the path of travel of the drive belt 54.

As shown in FIGS. 3 and 5, each idler pulley is mounted on an adjustable stand 76. To this stand, according to the present invention, is attached a spacer bar 79, welded to a pair of L-shaped members 78, said members engaging the top of the flange rail 74. Isolation pads 80, which may be of rubber, are interposed between the L-shaped members 78 and the top of the rail 74.

The rail 74 is provided with apertures 82 for receiving mounting bolts 84, which are isolated from the rail by tubular Teflon bushings 77. A nut 86 is screwed on to bolt 84 to hold a plate member 88 in tightened engagement with another isolation pad 90, which is interposed between the plate 88 and the flange rail 74. Similarly, an isolation pad 92 is disposed between the spacer bar 79 and the other side of the flange rail 74. With the foregoing arrangement, the mounting of the pulleys 56 on the flange rail 74 can be securely effected in a manner that will substantially eliminate any structural vibration path from the pulley to the mounting rail during the operation of the texturing machine.

In addition, it has been found that the pulleys 56 when rotated at high speed emit a high frequency noise due to resonant vibration. According to the present invention, the generation of this high frequency noise is substantially reduced by the provision of a sleeve 94 which is constructed from a metal that is dissimilar with respect to the metal of the pulley 56. Specifically, where the body 96 of the pulley is of steel alloy, the sleeve 94 should be aluminum, which is press-fitted about the circumference of the body 96. As a result of the increase in the diameter of the pulley 56 by the provision of the sleeve 94, the pulley 56 will rotate at a lower rotational velocity when in use, thus further contributing to a reduction in noise level from this source.

Figure 6:
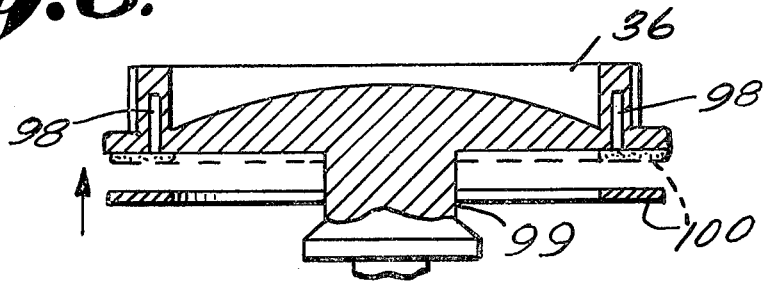
FIG. 6 is a view in elevation, partly in section, of a tape pulley.

As illustrated in FIG. 6, it has been discovered that another noise source that can be relatively easily suppressed is found in the balancing holes 98, which are formed in the underside of the tape pulleys 36. According to the present invention, the high frequency noise, which is emitted when the pulleys 36 are rotated at high speeds, can be entirely eliminated by simply cementing or otherwise securely adhering a thin plastic disc a annulus 100 so as to completely cover the balancing holes 98 for each of the tape pulleys. Thus, with this relatively inexpensive modification, a source of high frequency noise is eliminated.

Figure 8:
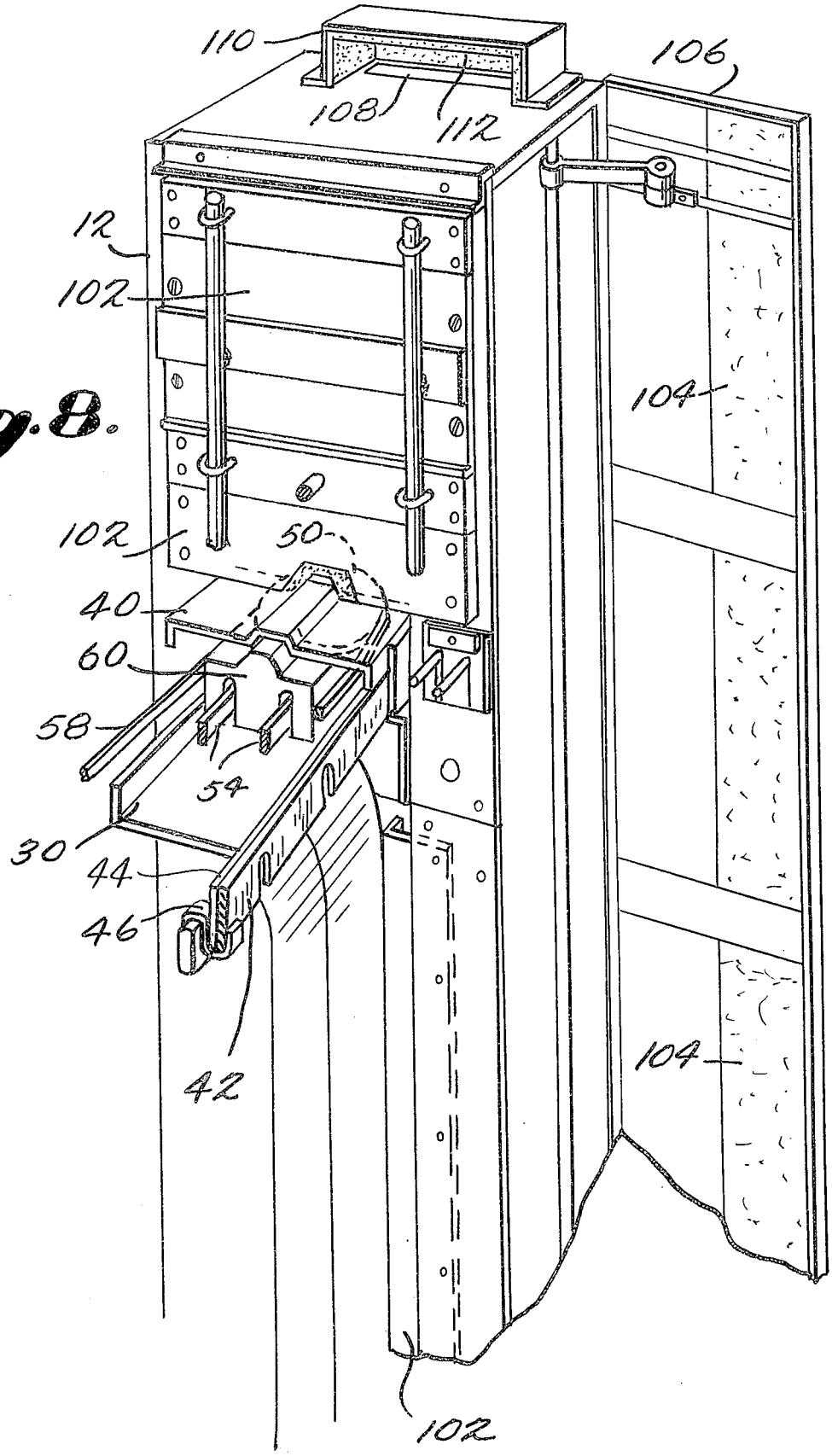
FIG. 8 is a perspective view with parts broken away of the gear housing showing the mounting relation of the head end tape pulley and sound insulation panels with respect thereto.

In the Lessona 553 machine, as well as a number of other false twist texturing machines, the gear housing 12 (see FIG. 8) has a number of openings which, according to the present invention, are closed by damped sheet metal panels 102. Panels 102 may have their inside surfaces lines with polyurethane foam or other sound absorbing material. Clearly, the panels may be of any desired shape to fit the openings found on a specific housing. Also, sound absorption panels, such as at 104, should be used to line the inside surface of the door 106 of the housing 12. It has also been found useful to reposition and sound insulate the cooling vent opening 108 of the gear housing 12 by placing the opening in the top of the housing and surrounding the opening with a partial enclosure 110, which is lined with suitable sound absorbing material 112. The original opening in the end of the housing is sealed off.

In some spindle platform portions of texturing machines, it may be necessary to provide additional insulating walls between the pulley cover 40 and the spindle platform 30, to complete the enclosing of the head end tape pulley 50.

Another source of noise has been found to be the spindle tape 58 interaction with the spindle whorls. According to the present invention the conventional half-inch woven-surface tapes are replaced by ⅝-inch rubber-surfaced tapes to reduce the tangential tape drive noise.

Another source of noise is the V-notch threading aid at the top of each spindle, which produces a periodic pressure disturbance at a frequency twice that of the spindle rotational speed. Removing the V-notch and all perforations in the spindle wall eliminates this source of noise, amounting generally to an additional 2 or 3 dB(A) reduction after all the other above modifications have been made on the machine.

As a result of implementing the foregoing techniques a noise reduction of 8–10 dB(A) has been documented at a typical operator position in the center of a Leesona 553 36-spindle machine section running at 300,000 rpm. Measurements before and after modifying the machine were made at a position 60 inches high, measured vertically from the operator ramp, and 20 inches out, measured horizontally from the spindle line of the machine. The machine was situated on a hard reflecting plane in an otherwise acoustically soft environment with low ambient noise levels.

With the foregoing noise abatement devices, it will be seen that free access to the production portions of the machine is still provided and a very satisfactory reduction in noise level will be obtained. Further, it will be appreciated that implementing the noise abatement procedures described above will be relatively inexpensive, thus rendering it very practical to incorporate such modification in texturing machines.

As will be apparent to those skilled in this art, various modifications to the foregoing procedures and devices may be employed without departing from the spirit and scope of the present invention as defined in the appended claims.

What is claimed is:

1. Noise abatement apparatus for a yarn texturing machine of the type having a frame extending between a gear housing and a motor housing, a plurality of rotatable devices spaced longitudinally along said frame, a plurality of pulley means mounted on said frame and spaced longitudinally therealong, an endless drive belt extending from within said motor housing along said frame and into said gear housing and in driving engagement with a portion of each said pulley means, a plurality of idler pulleys, means for mounting said idler pulleys along said frame in engagement with said endless drive belt, an endless driven belt extending along said pulley means and in engagement with another portion of each said pulley means and in driving engagement with each of said rotatable devices, said texturing machine further including yarn transport means and heater means mounted on said frame, said noise abatement apparatus comprising:

a. means for enclosing a said pulley means located adjacent to said gear housing, said enclosing means including pairs of openings for said endless drive belt and said endless driven belt, b. means for isolating vibrations of said idler pulleys' mounting means from said frame, c. means for reducing sound generation from said idler pulleys and simultaneously reducing the rotational velocity of said idler pulleys when said idler pulleys are being rotated by said endless drive belt.

2. The noise abatement apparatus as claimed in claim 1 wherein each of said pulley means includes a circular portion having balancing holes formed therein at spaced intervals and said noise abatement apparatus includes closure means for said balancing holes carried on said circular portions.

3. The noise abatement apparatus as claimed in claim 2 wherein said closure means comprises a disc of plastic material covering said balancing holes.

4. The noise abatement apparatus as claimed in claim 1 wherein said means for enclosing a said pulley means located adjacent to said gear housing includes a first wall portion disposed to extend toward said gear housing substantially parallel to the plane of rotation of said pulley means and spaced vertically above said pulley means, a second wall portion engaging said first wall portion and extending generally perpendicularly from said first wall portion to enclose the sides of said pulley means and said endless drive and driven belts, said second wall portion having spaced pairs of slots formed therein defining said openings for said respective belts.

5. The noise abatement apparatus as claimed in claim 4 wherein said enclosing means further includes third wall portions defining tunnels for said drive belts, said tunnels being lined with a sound absorbing material.

6. The noise abatement apparatus as claimed in claim 1 wherein said mounting means for said idler pulleys includes a rail extending along said frame and L-shaped members for engaging said rail, said means for isolating vibrations of said mounting means including resilient pads interposed between said members and said rail for each idler pulley.

7. The noise abatement apparatus as claimed in claim 1 wherein each said idler pulley comprises a circular member having a belt-engaging surface constructed from a selected metallic material and said means for impeding sound propagation from said idler pulleys and simultaneously reducing the rotational velocity of said idler pulleys comprises a sleeve closely fitted around the exterior, belt-engaging surface of each idler pulley, said sleeve being made from a metallic material different from said selected metallic material, said sleeve having a predetermined radial thickness.

8. The noise abatement apparatus as claimed in claim 7 wherein said circular member is steel and said sleeve is aluminum.

9. A noise abatement method for a yarn texturing machine of the type having a motor housing at one end of the machine, a gear housing at the other end thereof, a frame extending between said housings, a plurality of rotatable spindles spaced along said frame, a plurality of pulleys mounted on said frame and spaced longitudinally therealong, an endless drive belt extending from said motor housing, along said frame and into said gear housing with said drive belt being in driving engagement with a portion of each said pulley means, a plurality of idler pulleys, means for mounting said idler pulleys along said frame in engagement with said endless drive belt, an endless driven belt extending along said pulley means and in engagement with another portion of each said pulley means so as to be driven thereby, said endless driven belt being in driving engagement with said rotatable spindles, said yarn texturing machine further including yarn transport means and heater means mounted on said frame, said method comprising the steps of:

a. enclosing the pulley located adjacent to said gear housing with enclosure walls lined with sound absorbing material, b. providing, with said enclosure walls, tunnels for said endless drive belt and lining said tunnels with sound absorbing material, c. providing cushioning means for said mounting means for said idler pulleys, and d. providing sound reducing means on the rotatable portion of each idler pulley.

10. The method as claimed in claim 9 wherein each said pulley is formed with balancing holes and the method includes the step of closing said balancing holes.

11. The method as claimed in claim 9 wherein the step (d) comprises pressing an outer sleeve of a metal that is dissimilar to the metal of said idler pulleys on each idler pulley.

* * * * *

UNITED STATES PATENT OFFICE

CERTIFICATE OF CORRECTION

Patent No. 4,031,690 Dated June 28, 1977

Inventor(s) Lorimer P. Thomas and Robert H. Walker

It is certified that error appears in the above-identified patent and that said Letters Patent are hereby corrected as shown below:

Column 2, line 13: "beem" should be -- been --;
Column 2, line 30: "are" should be -- as --;
Column 4, line 7 : after "employed" delete "is";
Column 5, line 37: "adherance" should be -- adherence --;
Column 6, lines 19-20: "a annulus" should be -- or annulus --;
Column 6, line 29: "lines" should be -- lined --.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*